US008935944B2

(12) United States Patent
Boesel et al.

(10) Patent No.: US 8,935,944 B2
(45) Date of Patent: Jan. 20, 2015

(54) HASP SEAL LOCK ASSEMBLY

(71) Applicant: VSI, LLC, Green Bay, WI (US)

(72) Inventors: Lucas Boesel, Muskego, WI (US); Joshua Miller, Milwaukee, WI (US); Jay Yaeso, Suamico, WI (US)

(73) Assignee: VSI, LLC, Green Bay, WI (US)

( * ) Notice: Subject to any disclaimer, the term of this patent is extended or adjusted under 35 U.S.C. 154(b) by 0 days.

(21) Appl. No.: 13/890,578

(22) Filed: May 9, 2013

(65) Prior Publication Data

US 2013/0239627 A1 Sep. 19, 2013

Related U.S. Application Data

(63) Continuation-in-part of application No. 13/383,680, filed as application No. PCT/US2011/036098 on May 11, 2011.

(60) Provisional application No. 61/333,810, filed on May 12, 2010.

(51) Int. Cl.

| | |
|---|---|
| ***E05B 67/38*** | (2006.01) |
| ***E05B 65/48*** | (2006.01) |
| ***E05C 19/08*** | (2006.01) |

(52) U.S. Cl.

CPC ..... *E05B 65/48* (2013.01); *E05C 19/08* (2013.01); *E05B 67/383* (2013.01)

USPC ..... 70/56; 70/2; 292/285

(58) Field of Classification Search

USPC ..... 70/2, 54, 56, 159, 417; 292/148, 281, 292/285, 286

See application file for complete search history.

(56) References Cited

U.S. PATENT DOCUMENTS

| | | | | | |
|---|---|---|---|---|---|
| 4,033,156 | A * | 7/1977 | Cottingham | 70/56 |
| 4,437,692 | A * | 3/1984 | Halopoff | 70/56 |
| 4,926,662 | A * | 5/1990 | Gaudet | 70/56 |
| 5,118,149 | A * | 6/1992 | Emmons | 70/56 |
| 5,271,649 | A * | 12/1993 | Gromotka | 292/113 |
| 5,307,653 | A * | 5/1994 | Davis | 70/56 |
| 6,010,166 | A * | 1/2000 | Hamilton et al. | 70/56 |
| 6,058,745 | A * | 5/2000 | Sanchez | 70/56 |
| 6,481,829 | B1 * | 11/2002 | Bailey et al. | 347/49 |
| 6,848,284 | B2 * | 2/2005 | Chen | 70/56 |
| 7,278,284 | B1 * | 10/2007 | James | 70/56 |

* cited by examiner

*Primary Examiner* — Christopher Boswell

(74) *Attorney, Agent, or Firm* — Joseph S. Heino; Patrick M. Bergin

(57) ABSTRACT

An improved hasp seal lock assembly includes a base member that is attached via a hinge to a cover member. The cover member can be rotated approximately 180° from a fully "closed" position, which is when it overlays a latch and seal, to a fully "open" position. The base member and the cover member each have a plurality of apertures defined in adjacent side walls that allow the horizontal latch arm to extend through the assembly. The base member and the cover member also include a second plurality of cooperating apertures whereby the base member and the cover member may be locked together by use of a padlock. In the preferred embodiment, each cover side wall includes a tab and tab-receiving apertures are defined within the base member. The tabs require that the cover be lifted vertically prior to rotation of the cover member about the base member.

9 Claims, 7 Drawing Sheets

HASP SEAL LOCK ASSEMBLY

This application is a continuation-in-part of U.S. patent application Ser. No. 13/383,680 filed Jan. 12, 2012; which is a 371 of PCT/US11/36098 filed May 11, 2011 which claims the benefit of and priority of U.S. Provisional Patent Application No. 61/333,810 filed May 12, 2010. The subject matter of each application is incorporated herein by reference.

FIELD OF THE INVENTION

The present invention relates generally to locks and to other security devices that use locks and locking mechanisms. More specifically, it relates to an improved lock assembly that is used to secure the latch to the door of a truck storage compartment, or to secure other similar latches that are used for other purposes. It also relates to a lock assembly that is used to protect security seals used with such latches, including strap style seals, wire style seals and bolt style seals. It also relates to such a lock assembly that is unitary in construction such that the assembly is easy to use and eliminates the risk of loss of component parts.

BACKGROUND OF THE INVENTION

Latches that are used for securing truck storage compartment doors are well known in the art. One particular type of latch supports and secures a horizontal bar by means of two connected structures. One structure is a first hasp portion, which is a generally J-shaped holder, and the other is a second hasp portion, which is a generally L-shaped drop-down or hanging latch member. The L-shaped latch member is configured to be rotatably secured to the back portion of the J-shaped holder. The structures are provided with complementary apertures through which the generally U-shaped shackle of a conventional padlock can be inserted such that the two structures can be locked together. The apertures are also used to attach a security seal of some sort through the latch hasp portions after the truck storage compartment has been loaded. If this security seal is damaged in any way prior to the cargo arriving at its destination, or if the security seal is missing altogether, the cargo compartment contents may be considered "suspect" and the load may not be accepted.

SUMMARY OF THE INVENTION

These inventors previously conceived a unitary, one-piece device or assembly for securely and inexpensively protecting the latch and latch hasp portions of a cargo or truck storage compartment door latch mechanism, and any security seal attached to the latch and its hasp portions. The assembly of that invention is disclosed in the applications referred to at the outset of this specification, which applications are incorporated herein by reference.

The present invention is the same as the prior assembly in that the base member that is attached via a hinge to a cover member. The cover member and the base member overlay the latch which prevents tampering of the latch and the security seal. The base member and/or the cover member each have cooperating cut-outs defined in adjacent side walls that allow the horizontal bar to extend through the cut-outs. In that way, the base member and the cover member can be "clamped" down over the latch such that the base member and the cover member can be locked together using a padlock. In the preferred embodiment, the cover side walls also include tabs which require that the cover be lifted vertically prior to rotation of the cover member about the base member.

However, the present invention is an improvement over the structure mentioned above in that the cover member is capable of being rotated upwardly approximately 180° such that the cover is positioned out of the way when the user is attaching or detaching the security seal. In the prior applications, the cover member is not capable of such full rotation, movement and positioning. The foregoing and other features of the improved hasp seal lock assembly of the present invention will be apparent from the detailed description that follows.

DETAILED DESCRIPTION OF THE INVENTION

Figure 1:
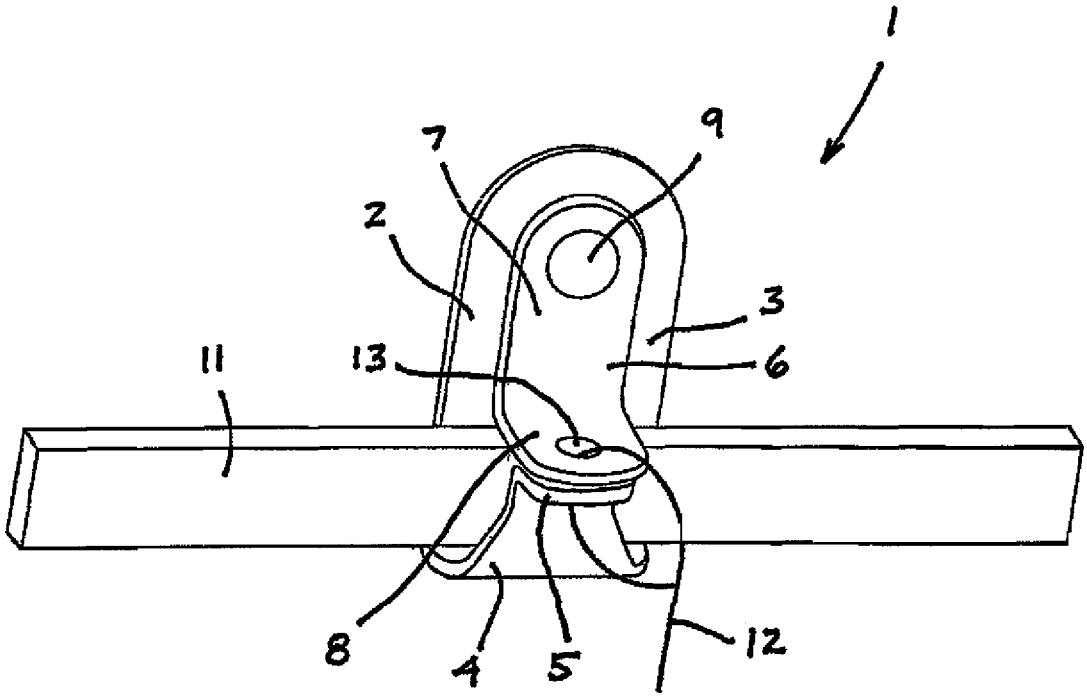
FIG. 1 is a perspective view of a latch and hasp seal mechanism known in the art.

Referring now to the drawings in detail, where like-numbered elements represent the same structure throughout, FIG. 1 is a perspective view showing a conventional latching or locking mechanism, generally identified 1, known in the art. The mechanism 1 is configured to be attached to the outer surface of a door of a cargo container or trailer (not shown) and comprises a generally J-shaped first hasp portion 2 and a generally L-shaped "drop-down" second hasp portion 6. The J-shaped first hasp portion 2 comprises a back 3 that is secured to the surface. The J-shaped first hasp portion 2 further comprises a lower portion 4 and an outwardly-projecting lower lip 5. The lip 5 has an aperture (not shown) in it. The L-shaped second hasp portion 6 is configured to be rotatably secured to the back 3 of the J-shaped first hasp portion 2 via a fastener 9. The L-shaped second hasp portion 6 comprises back 7 and an outwardly-projecting lip 8 having an aperture 13 in it. The apertures of the hasp portions 2, 6 are used to thread a hasp security seal 12 through them when a latch arm 11 is positioned between the hasp portions 2, 6 as shown. It is to be understood that the hasp security seal 12 could be a strap style seal, a wire style seal or a bolt style seal of the type known in the art.

Figure 4:
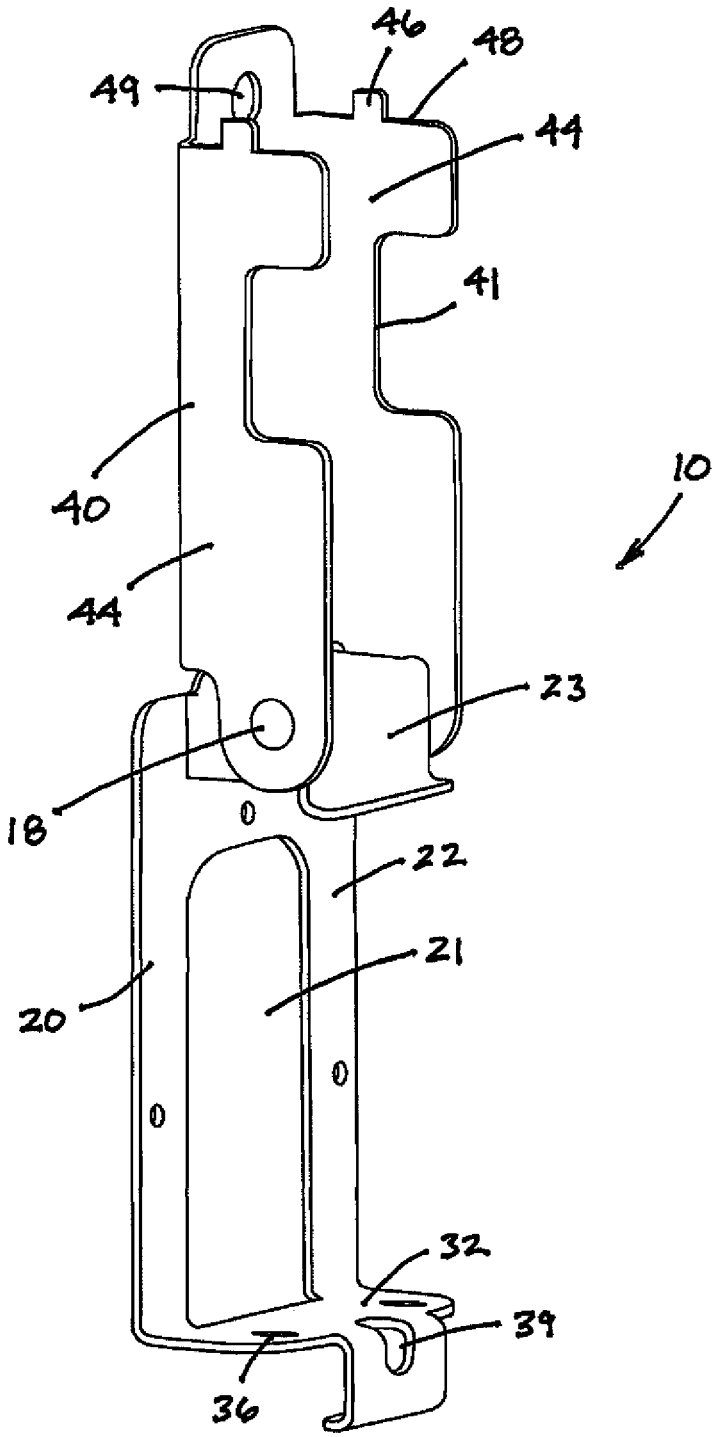
FIG. 4 is a perspective view of the base member and cover member and showing cover member of the improved lock assembly in the fully "open" position.
Figure 5:
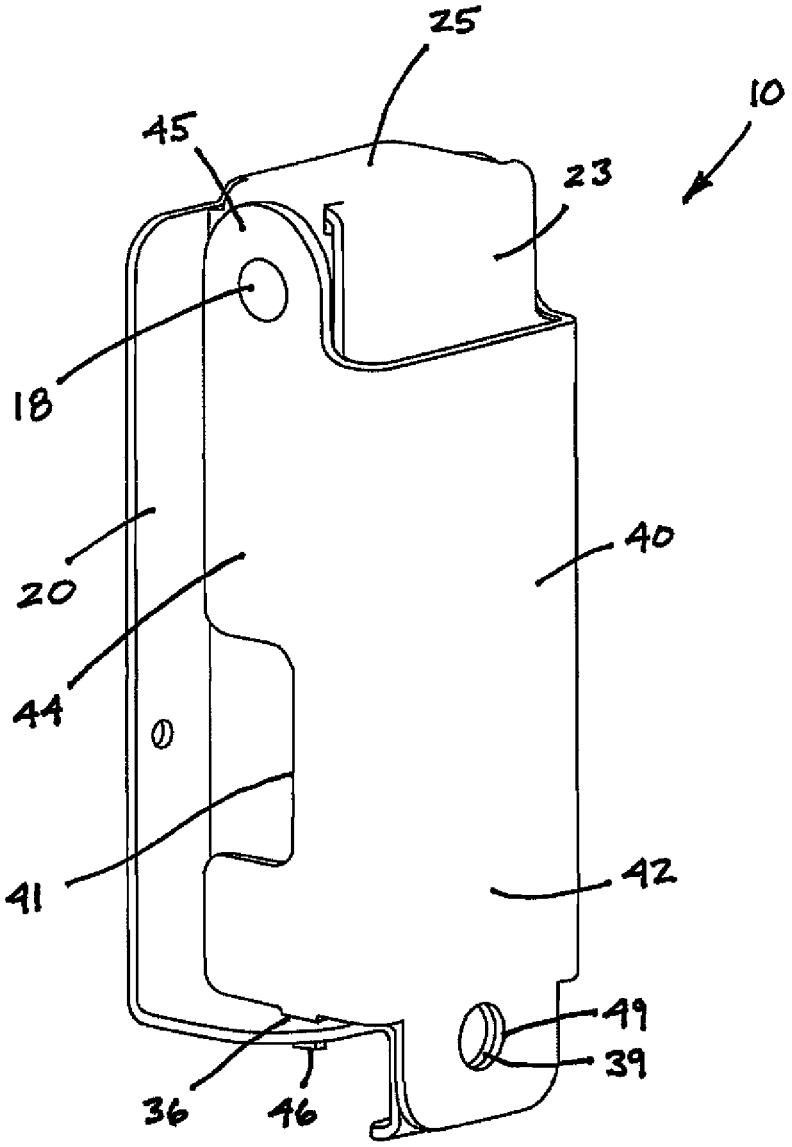
FIG. 5 is a view similar to FIG. 4 but showing the cover member in the fully "closed" position.

FIGS. 4 and 5 illustrate a preferred embodiment of the improved hasp seal lock assembly, generally identified 10, of the present invention. FIG. 4 shows the improved assembly 10 in a fully "open" position whereas FIG. 5 shows it in a fully "closed" position. The improved assembly 10 comprises a base member 20 and a cover member 40. When placed together as shown in FIG. 5, the base member 20 and the cover member 40 form a generally rectangular box-like structure that prevents access to the hasp portions 2, 6 of the latch mechanism 1 and to the hasp security seal 12 placed through the hasp portions 2, 6.

Figure 2:
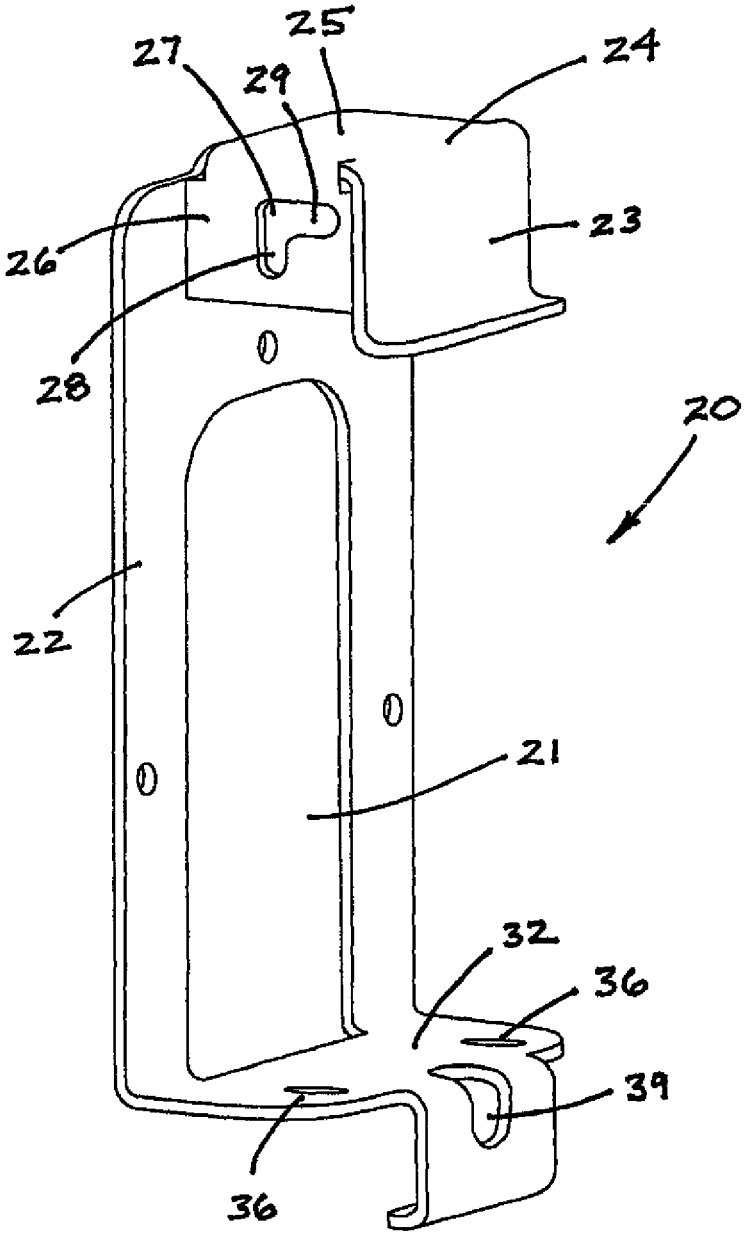
FIG. 2 is a perspective view of the base member of the improved hasp seal lock assembly of the present invention.

Referring to FIG. 2, it will be seen that the base member 20 comprises a flat planar back portion 22, an outwardly extending top portion 24 and an outwardly extending bottom portion 32. An opening 21 is formed within the back portion 22 to allow the assembly 10 to be mounted atop the latch and hasp seal mechanism 1 shown in FIG. 1. FIG. 2 shows that the top portion 24 of the base member 20 includes a flat 25, a downwardly extending front leg 23 and a pair of downwardly extending side legs 26. Each downwardly extending side leg 26 further comprises an L-shaped aperture 27. The L-shaped aperture 27 comprises a substantially vertical aperture portion 28 and a substantially horizontal portion 29.

Figure 3:
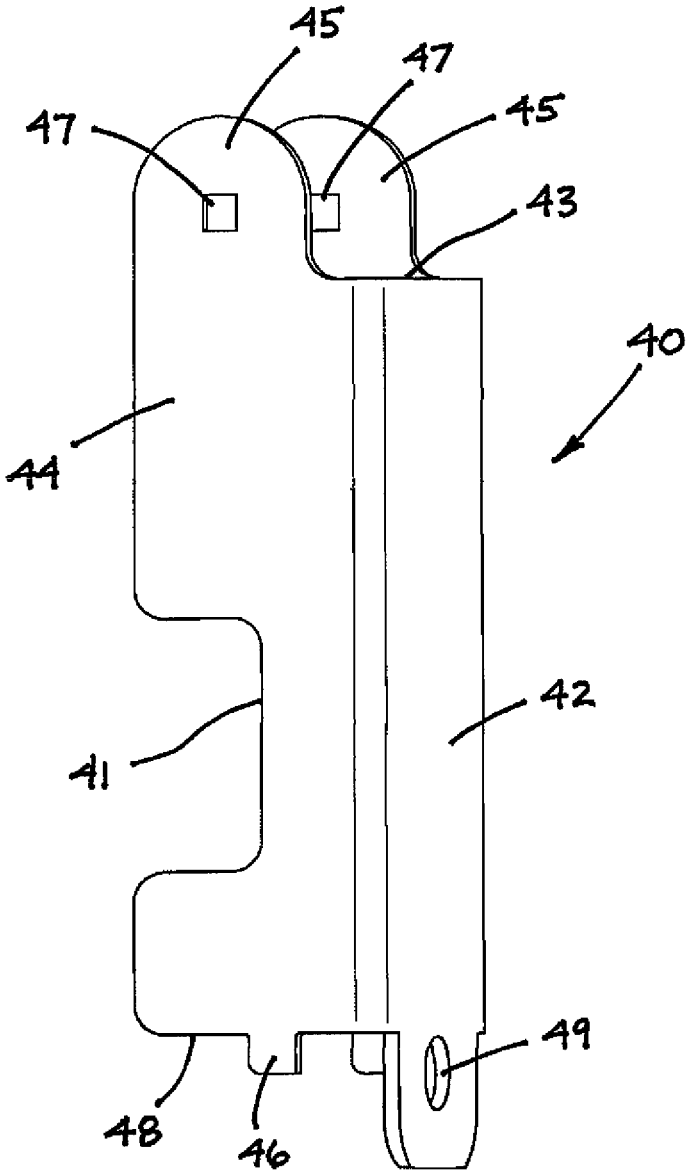
FIG. 3 is a perspective view of the cover member of the improved hasp seal lock assembly of the present invention.

A fastener, such as a bolt and connecting nuts, rivets or even a single pin 18, may be received by this L-shaped aperture 27. See FIG. 4. The fastener 18 is also inserted generally horizontally through apertures 47 that are defined within the round upper portions 45 of the rearwardly extending side walls 44 of the cover member 40. See FIG. 3. The cover member 40 can then rotate approximately 180° upwardly and downwardly about the fastener 18 relative to the top portion 24 of the base member 20. The fastener 18 can also be flattened at each end to provide security for the assembly 10 once the fastener 18 is inserted.

Figure 6:
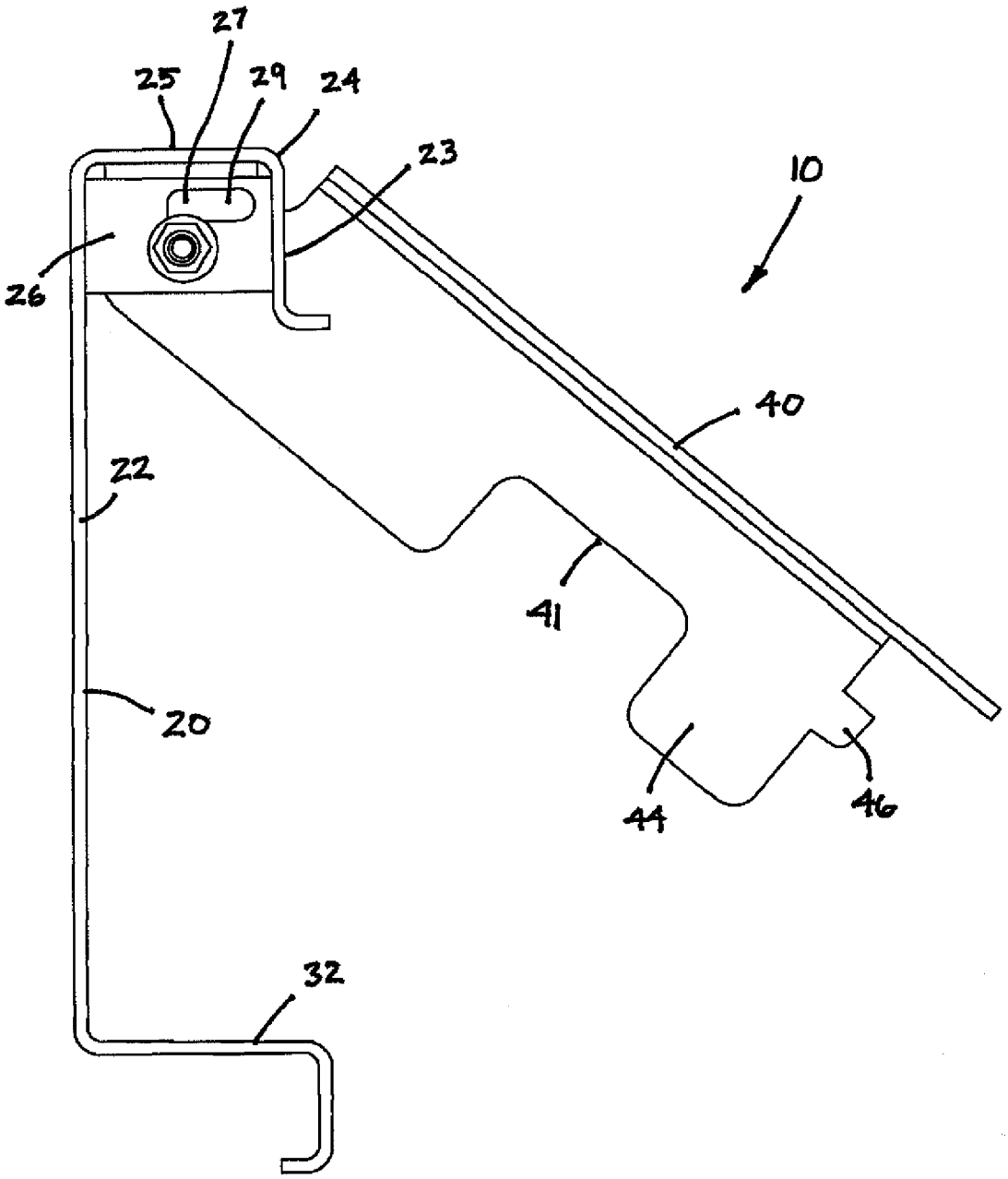
FIG. 6 is left side elevational and cross-sectioned view of the improved assembly, such view showing the cover being partially lifted.
Figure 7:
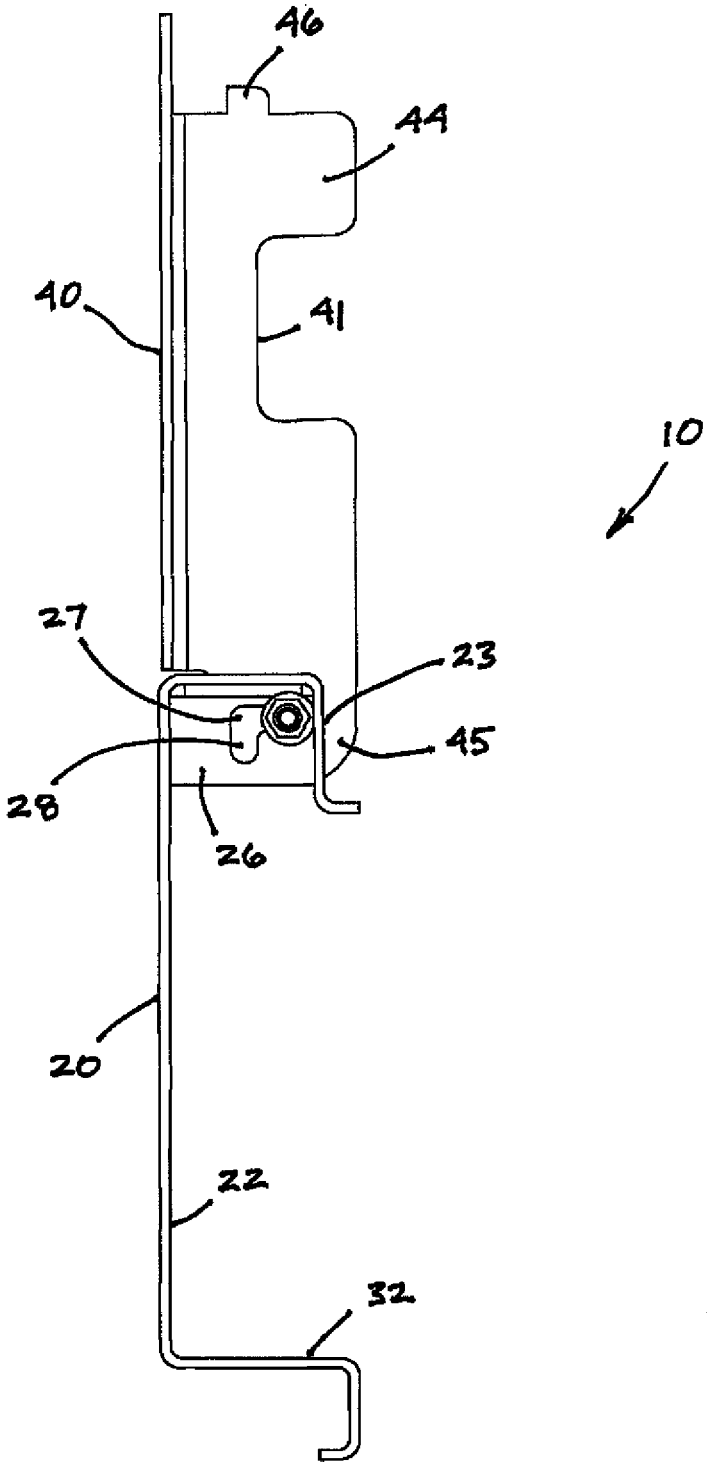
FIG. 7 is a left side elevational and cross-sectioned view of the improved assembly, such view being similar to that of FIG. 4.

The L-shaped apertures 27 provide part of the means for locating the cover member 40 relative to the base member 20 since they allow the cover member 40 to be elevated slightly vertically relative to the base member 20. That is, the cover member 40 and fastener 18 can be elevated slightly vertically, the fastener 18 moving vertically within the vertical portion 28 of the slot-like aperture 27 defined in each of the side legs 26 of the top portion 24 of the base member 20. See FIG. 6. The L-shaped apertures 27 also provide means for the fastener 18 to move horizontally within the horizontal portion 29 of the L-shaped aperture 27. See FIG. 7.

The cover member 40 further comprises a front wall 42 having an upper edge 43. This upper edge 43 of the front wall 42 is positioned lower than the upper edge of the assemblies described in the prior applications mentioned at the outset. That is, the upper edge 43 is shorter to allow the front wall 42 to clear the front leg 23 of the base member when the cover member 40 is raised to its fully open position. The horizontal portion 29 of the L-shaped aperture 27 also allows the cover member 40 to be moved forwardly of the base member 20 which provides the necessary clearance to raise the cover member 40 to the point that it is shown, for example, in FIG. 4. Once in the fully raised, or open, position, the cover member 40 will maintain its position while the user handles the hasp seal lock 1 and hasp security seal 12 as previously described.

Referring again to FIG. 3, it will be seen that the cover member 40 further comprises a pair of tabs 46, one extending downwardly from the lower edge 48 of each of two side walls 44. A latch arm opening 41 is also defined in each side wall 44, the opening 41 allowing a portion of the latch arm 11 to extend through the assembly 10. Referring again to FIG. 2, it will be seen that the bottom portion 32 of the base member 20 comprises a forwardly extending flat having a pair of slot-like apertures 36 defined in it. Each aperture 36 is configured to receive a tab 46 of the cover member 40 within it. The use of the tabs 46 in the assembly 10 is important because it requires that the cover member 40 be lifted slightly vertically so that the tabs 46 can first disengage from the apertures 36 after which the cover member 40 can then be rotated and fully opened. A lock-receiving aperture 39 is disposed centrally within the bottom portion 32 of the base member 20 as well. This aperture 39 aligns with a similar lock-receiving aperture 49 that is defined in the bottom of the face portion 42 of the cover member 40. These apertures 39, 49 allow the cover member 40 and base member 20 to be locked together using the shackle (not shown) of a conventional padlock (also not shown).

Additional advantages and modifications will readily occur to those skilled in the art. Therefore, the invention in its broader aspects is not limited to the specific details disclosed and described herein. Accordingly, various modifications may be made without departing from the spirit or scope of the general inventive concept. In particular, it is to be understood that the other embodiments of the improved hasp seal lock assembly 10 of the present invention specifically include those disclosed and claimed in the prior applications from which this application continues.

The details of the invention having been disclosed in accordance with the foregoing, we claim:

1. An improved hasp seal lock assembly comprising:

a base member, the base member comprising a forwardly extending top portion having a flat and a pair of side legs extending downwardly from opposing sides of the flat, each side leg comprising an L-shaped aperture, the L-shaped aperture comprising a vertical portion and a horizontal portion; the base member further comprising a bottom portion having at least one slot;

a cover member, the cover member comprising a front wall and a pair of side walls extending rearwardly from the front wall, the front wall having an upper edge; each side wall comprising a substantially round upper edge with an aperture defined in the round upper edge; each side wall extending above the upper edge of the front wall; and the cover member side members further comprising a lower portion and at least one of the side members having a tab extending downwardly from such lower portion;

at least one fastener for rotatably securing the cover member to the base member, the at least one fastener being movable along the vertical portion of the L-shaped aperture of the base member to allow the cover member to be elevated relative to the base member and further being movable along the horizontal portion of the L-shaped aperture to allow the cover member to be moved forwardly of the base member; and means for locking the cover member to the base member using a lock having a shackle;

wherein the tab of the at least one cover side member is insertable into the at least one slot of the base member bottom portion to locate the cover member relative to the base member.

2. The improved assembly of claim 1 wherein the base member comprises a flat planar back portion, a top portion and a bottom portion, the back portion comprising an opening to allow the assembly to be mounted over a latch and hasp seal mechanism.

3. The improved assembly of claim 1 wherein the tab has a rounded rear edge.

4. The improved assembly of claim 1 wherein the locking means comprises a lock-receiving aperture defined in the bottom portion of the base member and a lock-receiving aperture defined in the bottom of the cover member, the apertures being aligned when the cover member is closed relative to the base member and the apertures being used to receive the shackle of a padlock.

5. An improved hasp seal lock assembly for use with a latch and hasp seal mechanism, the mechanism comprising a first hasp portion and a second hasp portion, the hasp portions having aligned apertures such that a security seal can be secured through the hasp portions, and a latch arm, a portion of the latch arm being positioned between the hasp portions, the lock assembly comprising:

a base member, the base member comprising a flat planar back portion, a top portion and a bottom portion, the back portion comprising an opening to allow the assembly to be mounted over the latch and hasp seal mechanism; the base member further comprising a top portion having a flat and a pair of opposing and downwardly extending side legs and a downwardly extending front leg, each side leg comprising an L-shaped aperture; the L-shaped aperture of each side leg comprising a vertical portion and a horizontal portion;

a cover member, the cover member comprising a front wall having an upper edge and a pair of side walls, the side walls extending rearwardly from the front wall and each side wall comprising an opening, a substantially rounded upper edge and an aperture, and the upper edge of each side wall extending above the upper edge of the front wall;

means for securing the cover member in a fully open position relative to the base member and alternatively in a fully closed position relative to the base member, the fully open and fully closed positions being approximately 180° apart;

means for locating the cover member relative to the base member; and means for locking the cover member to the base member using a lock having a shackle.

6. The improved assembly of claim 5 wherein the cover member securing means comprises at least one fastener that is inserted through the apertures of the base member and the cover member; the at least one fastener being movable along the vertical portion of the L-shaped aperture of the base member to allow the cover member to be elevated relative to the base member and the at least one fastener further being movable along the horizontal portion of the L-shaped aperture to allow the cover member to be moved forwardly of the base member.

7. The improved assembly of claim 6 wherein the base member further comprises a bottom portion having a forwardly extending flat having a pair of slot-like apertures defined in it and the cover member locating means comprises a tab extending downwardly from a lower edge of each of the cover side walls, the tabs being received within the slot-like apertures of the bottom portion flat.

8. The improved assembly of claim 7 wherein the cover member locating means further comprises each tab having a rounded rear edge.

9. The improved assembly of claim 8 wherein the locking means comprises a lock-receiving aperture defined in the bottom portion of the base member and a lock-receiving aperture defined in the bottom of the cover member, the apertures being aligned when the cover member is closed relative to the base member and the apertures being used to receive the shackle of a padlock.

* * * * *